US006361003B1

(12) United States Patent
Keoun

(10) Patent No.: US 6,361,003 B1
(45) Date of Patent: Mar. 26, 2002

(54) AERIAL BUCKET SUPPORT APPARATUS

(76) Inventor: L. Craig Keoun, 13816 Spring Hollow Rd., Fort Wayne, IN (US) 46804

( * ) Notice: Subject to any disclaimer, the term of this patent is extended or adjusted under 35 U.S.C. 154(b) by 0 days.

(21) Appl. No.: 09/432,243

(22) Filed: Nov. 2, 1999

(51) Int. Cl.[7] ..... A47B 96/06
(52) U.S. Cl. ..... 248/213.2; 248/312.1
(58) Field of Search ..... 211/85.29, 70.6, 211/175; 108/42; 248/213.2, 346.01, 229.26, 230.7, 231.81, 295.11, 211, 210, 312.1

(56) References Cited

U.S. PATENT DOCUMENTS

| | | | | | |
|---|---|---|---|---|---|
| 1,816,049 | A | | 7/1931 | Larner | 206/496 |
| 2,697,479 | A | * | 12/1954 | Fesler | 297/411.25 |
| 3,329,290 | A | * | 7/1967 | Lowery | 414/508 |
| 3,477,679 | A | * | 11/1969 | Lovitz | 248/213.2 |
| 3,727,722 | A | * | 4/1973 | Hedges et al. | 182/129 |
| 4,480,810 | A | * | 11/1984 | Hall | 248/238 |
| 5,056,572 | A | * | 10/1991 | Del Vacchio | 144/286.5 |
| 5,064,090 | A | | 11/1991 | Farrier | 220/482 |
| D326,173 | S | | 5/1992 | Newbold | D34/6 |
| D340,622 | S | | 10/1993 | Park et al. | D7/620 |
| D355,336 | S | | 2/1995 | Dickey et al. | D7/620 |
| D364,539 | S | | 11/1995 | Dickey et al. | D7/620 |
| 5,493,751 | A | | 2/1996 | Misiukowiec et al. | 15/257.06 |
| 5,547,080 | A | | 8/1996 | Klimas | 206/373 |
| 5,704,496 | A | * | 1/1998 | Latta | 211/70.6 |
| 6,076,937 | A | * | 6/2000 | Wood et al. | 362/154 |
| 6,095,057 | A | * | 8/2000 | Corban | 108/42 |

* cited by examiner

*Primary Examiner*—Ramon O Ramirez
*Assistant Examiner*—Holly N. Sy
(74) *Attorney, Agent, or Firm*—Randall J. Knuth

(57) ABSTRACT

An aerial bucket support apparatus is comprised of a contoured support portion, for receiving and supporting an aerial bucket operator, and an attachment portion, for attaching to a wall of the aerial bucket. The aerial bucket support apparatus provides support to an operator when the operator may lean against the aerial bucket walls, providing more comfort and providing additional safety. The aerial bucket support apparatus can also include a recessed portion for housing tools.

31 Claims, 4 Drawing Sheets

AERIAL BUCKET SUPPORT APPARATUS

BACKGROUND OF THE INVENTION

1. Field of the Invention

This invention relates to a contoured support, and particularly, to a contoured structure for supporting an operator within an aerial bucket.

2. Description of the Related Art.

Aerial buckets are commonly used for carrying persons and tools to extended heights for working at elevated locations without the use of a ladder or other support. An aerial bucket is typically connected to a lifting mechanism, which in turn is usually connected to a vehicle or trailer.

An operator boards the aerial bucket at its lower most position, and is then raised to a level appropriate for the application. Often, an operator may lean over the sides of the aerial bucket in order to accomplish the operator's task.

If and when an operator leans over the side of an aerial bucket, a significant portion of the operator's weight is pushed against a side of the bucket, resulting in possible discomfort and fatigue.

SUMMARY OF THE INVENTION

The present invention provides an aerial bucket support having a receiving portion for receiving and supporting the legs or other portions of an aerial bucket operator, and an attachment means for connecting the receiving portion to the aerial bucket.

In an alternative embodiment of the present invention, a tool holder is further provided, for holding the tools of an operator.

According to the present invention, the support portion is contoured, having two arcuate recesses, each recess fitting a leg of an operator. Alternately, the support portion may be contoured to receive a different portion of the body, such as the waist or abdomen of the operator.

The preferred embodiment of the present invention shows the attachment means as comprising a substantially "S"-shaped clip, the clip sliding over a wall of the aerial bucket, and providing supportive pressure to the wall, thereby holding the clip in a steady position. According to the preferred embodiment of the invention, the top of the "S"-shaped clip rests on and is arranged over a top edge of the aerial bucket wall. Additionally, the bottom curve of the "S"-clip maybe formed to provide resilient pressure on a side of the wall of the aerial bucket that helps prevent movement of the support relative to the bucket. The resilient pressure that may be exerted by the "S"-clip provides additional stability to an operator who is in a leaning position. In another alternative embodiment of the invention, a tool holder is provided, the tool holder being disposed preferably adjacent the support portion, for facilitating storage and retrieval of the operator's tools. According to the present invention, a tool holder may comprise a hole or a recess for retaining tools.

In another alternative embodiment of the invention, a tool support is further provided, the tool support providing a means for hanging tools from a surface of the aerial bucket support.

In yet another alternative embodiment of the invention, an adjustment means is provided for adjusting the distance between the attachment means and the support portion, thereby providing comfortable use for persons of varying heights, in buckets of varying wall heights.

It is an advantage of the present invention that an aerial bucket support having a support receiving portion is provided, the support portion being contoured to provide more comfortable support for the operator. It is a further advantage of the present invention that an attachment means is provided with the support portion, the attachment means attaching the support portion to a wall of the aerial bucket.

Yet another advantage of the present invention is that a tool holder is provided for holding the operator's tools when they are not in use.

Yet a further advantage of the present invention is that an operator endures less stress and fatigue by using the present invention, therefore reducing the chance of injury.

Another advantage of the present invention is that it can be fitted to existing aerial buckets, therefore no new bucket or other device will need to be purchased to utilize the present invention.

Yet another advantage of the present invention is its ability to be adjusted, accommodating for persons of varying heights, and aerial bucket walls of differing heights.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
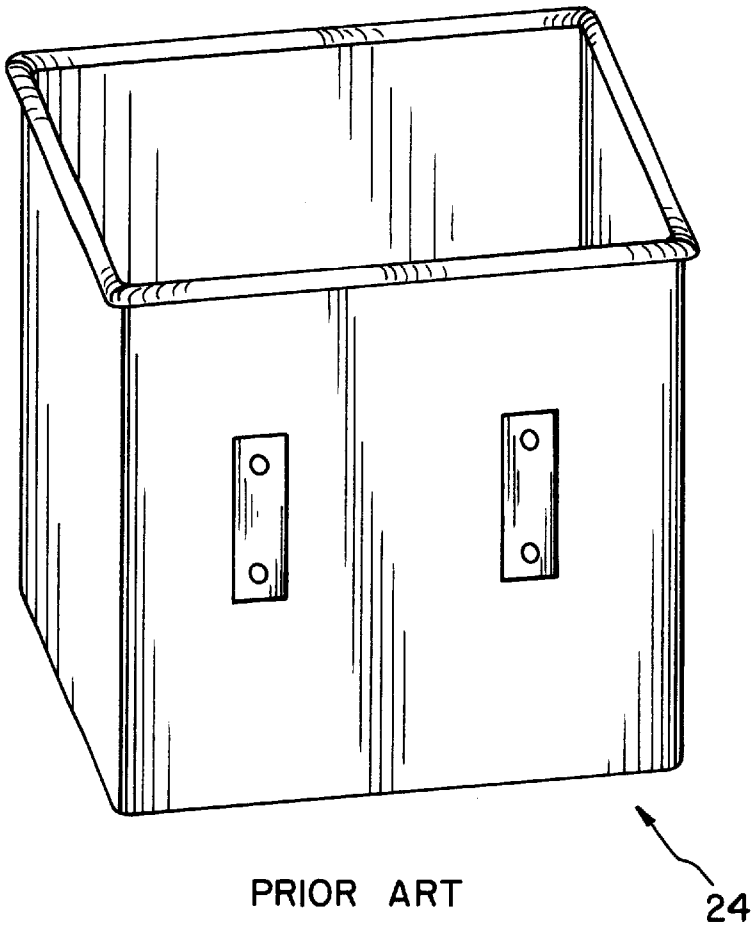
PRIOR ART Fig. 1
FIG. 1 is a perspective view of a prior art aerial bucket.

FIG. 1 shows a prior art aerial bucket, as is typical in the art. As shown in FIG. 1, an aerial bucket 24 is typically rectangular in shape, and has an open top portion with a rounded-over top edge around the perimeter of the walls.

Figure 2:
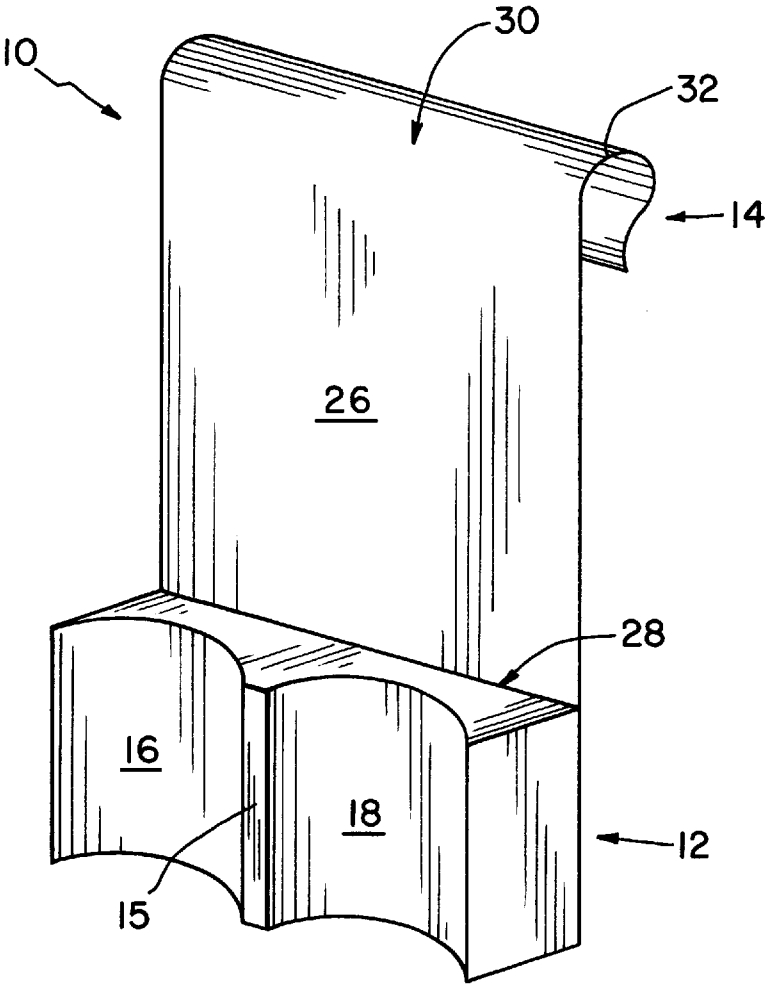
FIG. 2 is a perspective view of the preferred embodiment of an aerial bucket support.

As shown in FIG. 2, the present invention of the aerial bucket support apparatus 10 comprises a support portion 12 connected to an attachment portion 14. In the preferred embodiment of the invention, support portion 12 comprises a front side 15 having a first arcuate recess 16 and a second arcuate recess 18, the arcuate recesses receiving the legs of an aerial bucket operator. Other shapes and configurations, however, are possible. For example, the support portion 12 could be contoured and positioned to receive the waist or abdomen of the aerial bucket operator.

Figure 3:
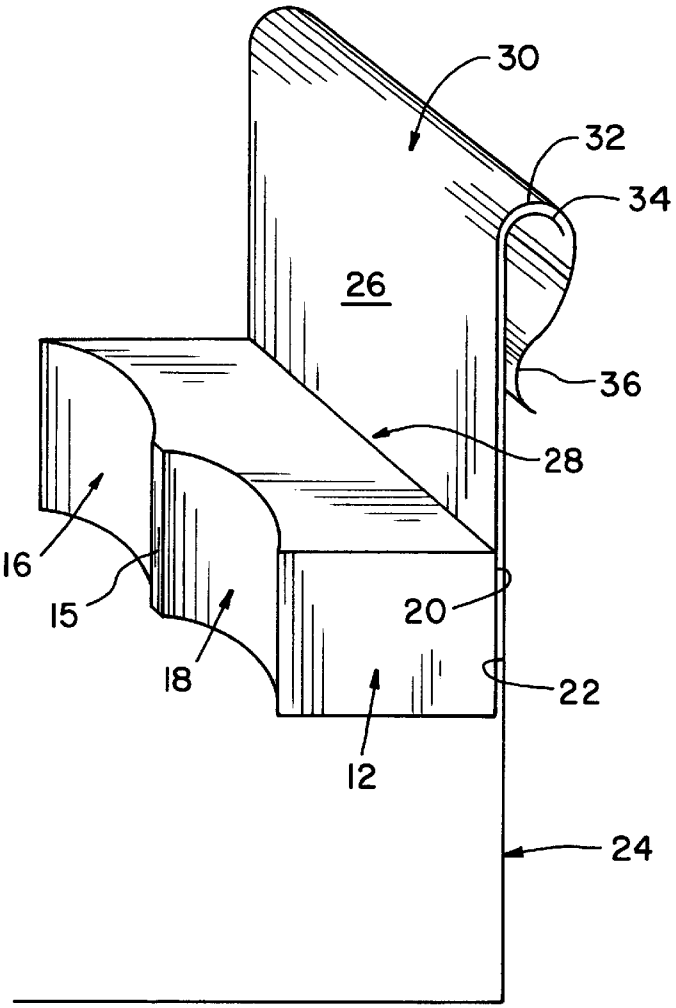
FIG. 3 is a perspective view of the aerial bucket support of FIG. 2 attached to an aerial bucket.

As shown in FIG. 3 a back side 20 of support portion 12 lies adjacent to a surface 22 of an aerial bucket 24. When an ID operator leans over surface 22 of aerial bucket 24, the operator's legs are pressed against arcuate recesses 16, 18 of support portion 12, therefore, a portion of the operator's weight is transferred to the aerial bucket surface 22.

Support portion 12 is connected to attachment portion 14, and in the preferred embodiment of the invention, a web 26 is disposed between the support portion and the attachment portion. Web 26 is shown in the preferred embodiment to be substantially rectangular in shape, however any shape with sufficient support to connect support portion 12 and attachment portion 14 is sufficient and anticipated by the invention. Web 26 is attached to support portion 12 at a first end 28, and is attached to attachment portion 14 at a second end 30. Additionally, support portion 12 extends from the plane formed by web 26 in a first substantially perpendicular direction, and attachment portion 14 extends in a second and opposite direction.

Figure 4:
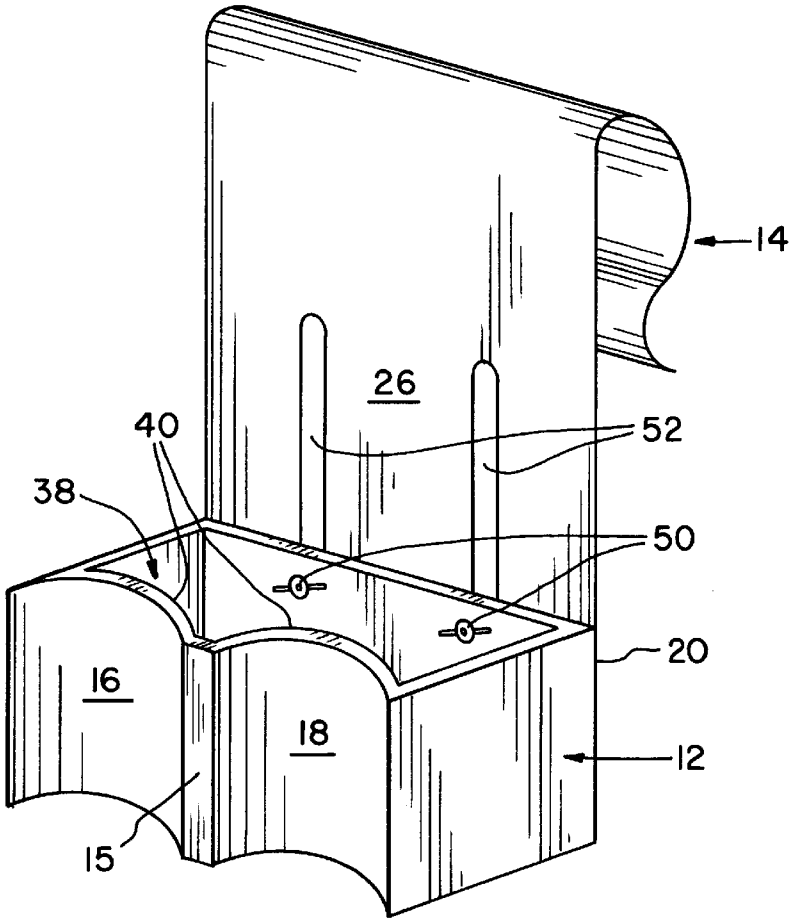
FIG. 4 is another embodiment of the aerial bucket support of FIG. 2, having a recess for tools.

In one embodiment of this invention, as shown in FIG. 4, web 26 has an adjustment means for adjustably selecting a distance between support portion 12 and attachment portion 14. By providing an adjustment means, the present invention can accommodate operators of different heights, and can fit aerial buckets with non-standard wall heights.

According to the invention, the adjustment means includes a fastener 50 and at least one aperture 52, the fastener 50 removably attaching support portion 12 to web 26 at positions defined by the at least one aperture 52. Apertures 52 may be circular in shape, may be an elongated slit, or any other shape that would permit the removable attachment of fastener 50. Preferably, as shown in FIG. 4, two elongated slits are provided as apertures 52, with two fasteners 50, such as wing nuts or quick-connecting fasteners, provided for removably and adjustably attaching the support portion 12 to the web 26. Therefore, when an operator chooses to adjust the positioning of the support portion 12, the operator needs only to detach the fasteners 50, slide support portion 12 to the desired position, and reattach the fasteners 50.

Attachment portion 14, as shown in FIG. 3, is preferably shaped as an "S"-clip wherein the top portion 32 of the "S"-shape rests on top edge 34 of the aerial bucket 24 and the bottom portion 36 of the "S"-clip providing resilient pressure on a side of the wall of the aerial bucket. While the preferred embodiment of the invention discloses an "S"-shaped attachment portion 14, there are many other means of attachment, including an "L" -shaped attachment portion, a "J"-shaped attachment portion, a suction cup attachment means, a strap, and a fastener attachment means, all being included in the scope of the invention.

In an alternative embodiment of the invention, as shown in FIG. 4, a recess 38 is provided in support portion 12, the recess 38 forming a housing capable of holding tools and the like. According to this embodiment of the invention, recess 38 is disposed between front side 15 and back side 20 of support portion 12. As shown in FIG. 4, recess 38, in one embodiment thereof, is shaped to conform to the contours of the outer surfaces of support portion 12 thereby maximizing the volume and holding capacity of recess 38. Therefore, recess 38 includes convex surfaces 40, which are defined by first arcuate recess 16 and second arcuate recess 18.

Other formations for recess 38, however, are within the scope of this invention. Recess 38 could alternately comprise any shape capable of being disposed between front side 15 and back side 20, including a solid rectangle, or even a series of apertures.

Figure 5:
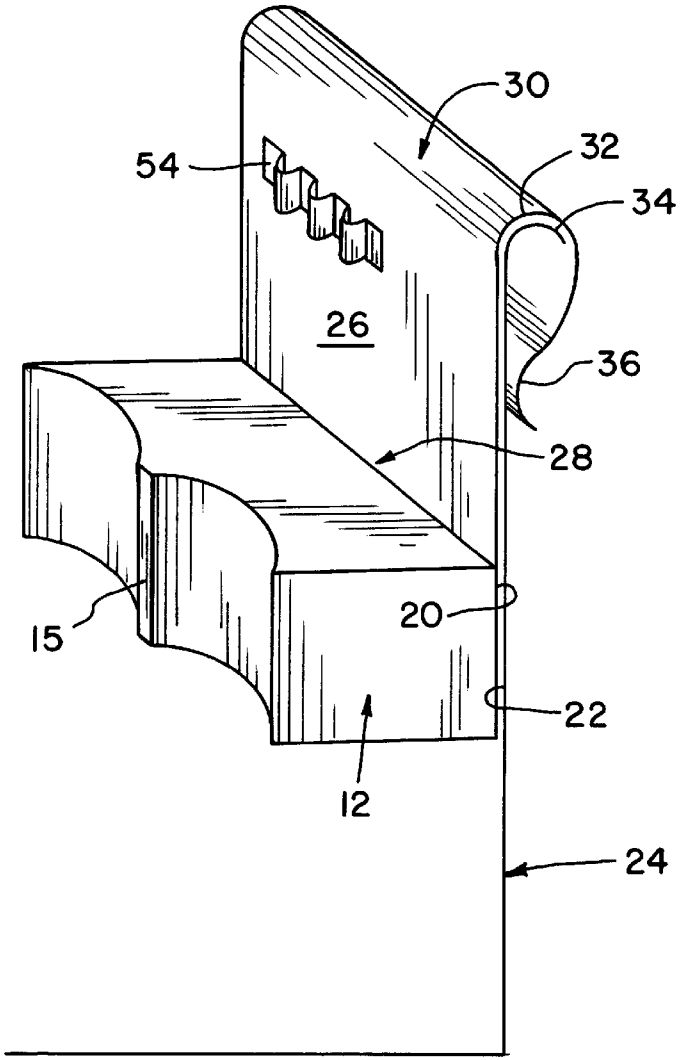
FIG. 5 is another embodiment of the aerial bucket support of FIG. 2, further illustrating a tool support.

In yet another alternative embodiment of the invention, as shown in FIG. 5, a tool support 54 is provided, the tool support 54 permitting tools to be suspended adjacent web 26. According to the invention, tool support 54 comprises a strap attached at selected positions to web 26, for supporting tools in a suspended manner between the strap and the web 26. However, tool support 54 is not limited by this embodiment, and the scope of the invention includes any other tool supporting means that attaches or suspends an operator's tools from a surface of the aerial bucket support apparatus 10.

Figure 6:
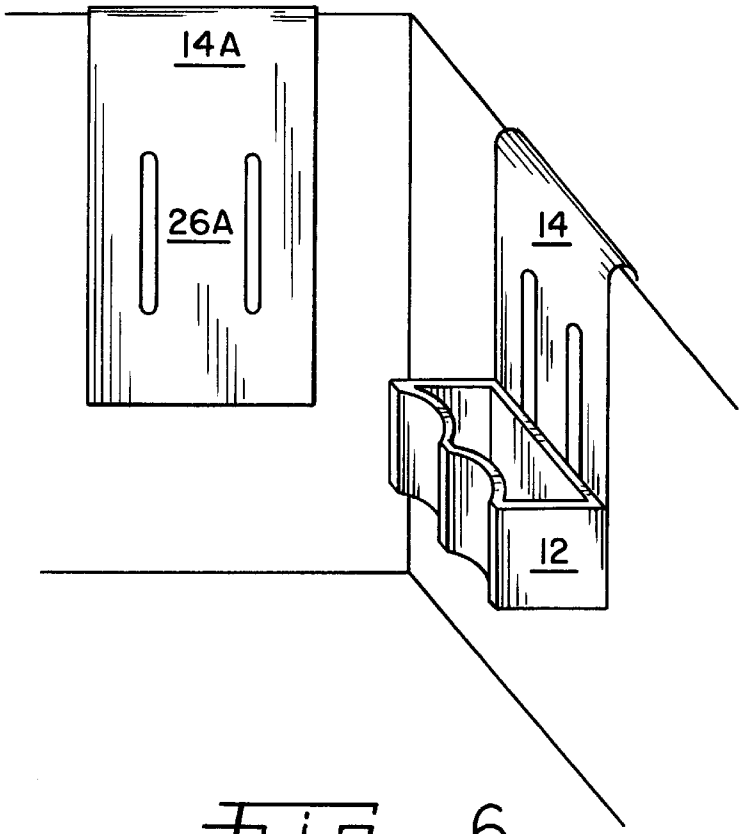
FIG. 6 is another embodiment of the aerial bucket support of FIG. 2, further illustrating a second attachment means.

In a further embodiment of the invention, as shown in FIG. 6, a second attachment portion 14A and integral web 26A is provided, for allowing support portion 12 to be repositioned on another wall of aerial bucket 24 without the removal of the first attachment portion 14.

Figure 7:
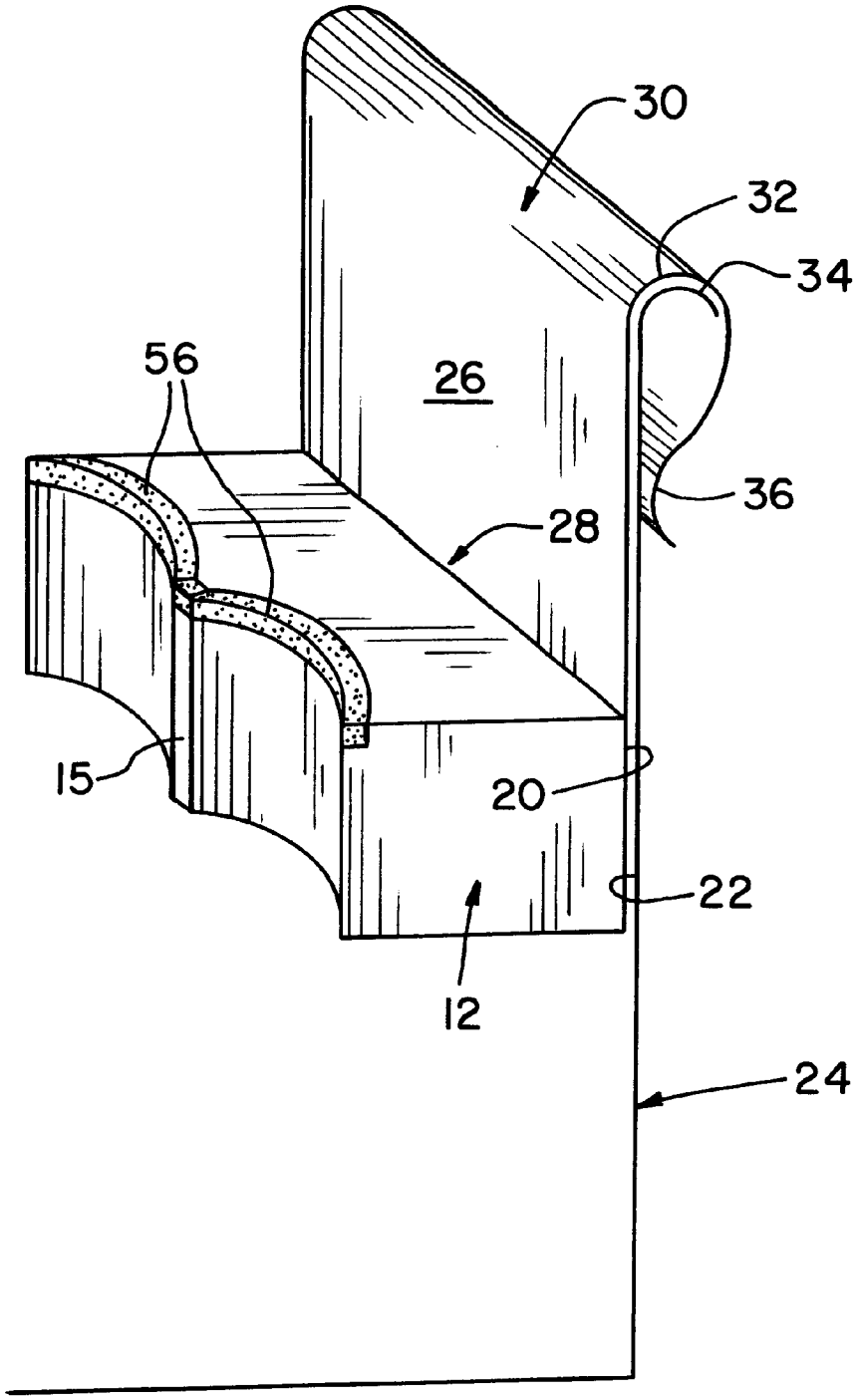
FIG. 7 is another embodiment of the aerial bucket support of in FIG. 2, further illustrating a knee support.

In still a further embodiment of the invention, as shown in FIG. 7, a knee rest 56 is additionally provided, the knee rest 56 engaged to the support portion 12 for supporting the knees of an operator when the operator is positioned closely between an opposing wall of the aerial bucket 24 and the aerial bucket support apparatus 10. Knee rest 56 is preferably comprised of a soft, padded material that can cushion the weight applied by an operator to support portion 12.

An aerial bucket support apparatus 10 is utilized substantially as follows. An operator slides aerial bucket support apparatus 10 over the edge 34 of aerial bucket 24, such that support portion 12 extends toward the inside of the aerial bucket 24, and attachment portion 14 faces toward the outside of the aerial bucket 24. The weight of the aerial support apparatus 10 is substantially supported by the top portion 32 of the support portion 12.

When an operator is lifted to the appropriate position, any activity requiring leaning outside of the aerial bucket 24 can be greatly facilitated with the use of aerial bucket support apparatus 10. An operator leaning against aerial bucket support apparatus 10 applies pressure against first arcuate recess 16 and second arcuate recess 18, such that back side 20 of support portion 12 is pressed against wall 22 of the aerial bucket 24. As necessary, an operator's abdomen or waist may also lean against the top of web 26, thereby providing additional leverage and support for the operator.

When the operator needs to move to a different surface of the aerial bucket 24, the operator simply pulls upward on aerial bucket support apparatus 10 until attachment portion 14 has released the edge 34 of surface 22, and repositions the aerial bucket support apparatus 10 in the new desired position on lip 34. In applications in which it may be difficult to pull up on the aerial bucket support apparatus 10, e.g. where the aerial bucket is too small to provide an operator room to lift the support apparatus, it can be advantageous to provide a second attachment portion 14A and integral web 26A, as shown in FIG. 6. Therefore, when an operator must change positions to a different wall of the aerial bucket, the operator can simply detach support portion 12 from attachment portion 14 via fasteners 50, and then reattach the support portion 12 to the second attachment portion 14A via fasteners 50.

The present invention can also include a convenient resting place for tools and other necessary items, defined as recess 38. Instead of searching or bending over for tools, the present invention allows an aerial bucket operator to continue work activity without even the shifting of weight to reach for the appropriate tool or other necessary item. Additionally, the present invention provides the advantage of support and comfort, allowing an operator to work more efficiently.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A support structure for an aerial bucket, comprising:

a support portion, for receiving and supporting an operator, said support portion defines a first recess and a second recess, said first recess for receiving and supporting a leg of an operator, and said second recess for receiving and supporting a second leg of an operator; and a means for attaching said support structure to an aerial bucket wherein said means is connected to said support protein.

2. The support structure of claim 1, wherein said support portion defines a recess for holding tools.

3. The support structure of claim 1, further comprising a tool support for supporting tools in a suspended manner.

4. The support structure of claim 1, wherein said first recess and said second recess are arcuate.

5. The support structure of claim 1, wherein said means comprises a clip.

6. The support structure of claim 5, wherein said clip is substantially "S" shaped, said clip for removably engaging a surface of the aerial bucket.

7. The support structure of claim 1, further comprising a second means, said support portion being removably connected to said second means for providing an alternate position for an operator.

8. The support structure of claim 1, further comprising a knee rest connected to said support portion, said knee rest including a padded surface for providing comfortable support to the knees of an operator.

9. The support structure of claim 1, further comprising a web having a length, said web being disposed between said support portion and said means.

10. The support structure of claim 9, wherein said web length is adjustable.

11. The support structure of claim 10, further comprising a fastener, wherein said web includes an at least one aperture and said fastener adjustably connects said support portion to said means through said at least one aperture.

12. The support structure of claim 11, wherein said fastener is a quick-connect fastener.

13. A contoured support apparatus for an aerial bucket, comprising:

a support portion having a first recess and a second recess, said first recess and said second recess being shaped for receiving an operator's legs; and an attachment portion connected to said support portion, said attachment portion removably attaching said support portion for to the aerial bucket.

14. The contoured support apparatus of claim 13, wherein said support portion defines a third recess for receiving tools.

15. The contoured support apparatus of claim 13, further comprising a web disposed between said support portion and said attachment portion.

16. The contoured support apparatus of claim 15, wherein said web is adjustable in length.

17. The contoured support apparatus of claim 16, further comprising a fastener, wherein said web includes at least one aperture and said fastener adjustably connects said support portion to said attachment portion through said at least one aperture.

18. The contoured support apparatus of claim 17, wherein said fastener is a quick-connect fastener.

19. The contoured support apparatus of claim 13, wherein said attachment portion includes an "S"-shaped clip for removably securing said contoured support apparatus to a wall of the aerial bucket.

20. The contoured support apparatus of claim 13, further comprising a tool support for supporting tools in a suspended manner.

21. The contoured support apparatus of claim 13, further comprising a second attachment portion, said support portion being removably connected to said second attachment portion for providing an alternate position for the person.

22. The contoured support apparatus of claim 13, further comprising a knee rest connected to said receiving portion, said knee rest including a padded surface for providing comfortable support to the knees of an operator.

23. A method of supporting an operator in an aerial bucket comprising the steps of:

providing a contoured support;

providing a means for attaching said contoured support to the aerial bucket; and providing an adjustable web disposed between said contoured support and said means, for adjusting a distance between said contoured support and said means.

24. The method of claim 23, further comprising the step of providing a means for retaining tools within the contoured support.

25. The method of claim 24, further comprising the step of providing a means for supporting tools in a suspended manner.

26. The method of claim 23, further comprising the step of providing a fastener, wherein said adjustable web includes an at least one aperture and said fastener adjustably connects said contoured support to said attachment means through said at least one aperture.

27. The method of claim 26, wherein said fastener is a quick-connect fastener.

28. The method of claim 23, further comprising the step of providing a second means, said second means providing an alternative location for attaching said contoured support to the aerial bucket.

29. The method of claim 23, further comprising the step of providing a knee rest connected to said contoured support, said knee rest including a padded surface for providing comfortable support to the knees of an operator.

30. The method of claim 23, wherein said contoured support provides support for an operator's legs.

31. The method of claim 23, wherein said means is an "S"-shaped clip.

* * * * *

UNITED STATES PATENT AND TRADEMARK OFFICE

CERTIFICATE OF CORRECTION

PATENT NO. : 6,361,003 B1
APPLICATION NO. : 09/432243
DATED : March 26, 2002
INVENTOR(S) : L. Craig Keoun It is certified that error appears in the above-identified patent and that said Letters Patent is hereby corrected as shown below:

Column 5, line 20, claim 1 should read:

a means for attaching said support structure to an aerial bucket wherein said means is connected to said support portion.

Signed and Sealed this
Twenty-sixth Day of June, 2012

David J. Kappos

David J. Kappos
*Director of the United States Patent and Trademark Office*